US010012042B2

(12) United States Patent
Vaughan

(10) Patent No.: US 10,012,042 B2
(45) Date of Patent: Jul. 3, 2018

(54) UNIVERSAL ROTATING STRIPPER ADAPTER

(71) Applicant: PREMIER COIL SOLUTIONS, INC., Waller, TX (US)

(72) Inventor: Phillip D. Vaughan, Richmond, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 0 days.

(21) Appl. No.: 15/706,933

(22) Filed: Sep. 18, 2017

(65) Prior Publication Data

US 2018/0080292 A1 Mar. 22, 2018

Related U.S. Application Data

(60) Provisional application No. 62/396,453, filed on Sep. 19, 2016.

(51) Int. Cl.

| | |
|---|---|
| ***E21B 3/04*** | (2006.01) |
| ***E21B 3/06*** | (2006.01) |
| ***E21B 19/22*** | (2006.01) |
| ***E21B 17/05*** | (2006.01) |
| ***E21B 33/06*** | (2006.01) |

(52) U.S. Cl.
CPC ..... *E21B 19/22* (2013.01); *E21B 3/04* (2013.01); *E21B 3/06* (2013.01); *E21B 33/06* (2013.01)

(58) Field of Classification Search
CPC ... E21B 3/04; E21B 3/06; E21B 19/22; E21B 19/24; E21B 17/05
See application file for complete search history.

(56) References Cited

U.S. PATENT DOCUMENTS

| | | | | |
|---|---|---|---|---|
| 3,268,233 A * | 8/1966 | Brown | E21B 33/085 | 277/343 |
| 3,934,887 A * | 1/1976 | Biffle | E21B 33/085 | 166/84.3 |
| 4,285,406 A * | 8/1981 | Garrett | E21B 33/085 | 175/195 |
| 5,647,444 A * | 7/1997 | Williams | E21B 33/085 | 166/84.1 |
| 8,286,734 B2 * | 10/2012 | Hannegan | E21B 7/02 | 166/84.1 |
| 2007/0284113 A1 * | 12/2007 | Haheim | E21B 19/004 | 166/345 |

* cited by examiner

*Primary Examiner* — Cathleen R Hutchins
(74) *Attorney, Agent, or Firm* — Lloyd L. Davis; Hunton Andrews Kurth LLP

(57) ABSTRACT

A stripper adapter mounted on a coiled tubing injector head unit includes a swivel ring secured between an upper thrust washer and a lower thrust washer, wherein the swivel ring is rotatable 360 degrees about a longitudinal axis.

2 Claims, 2 Drawing Sheets

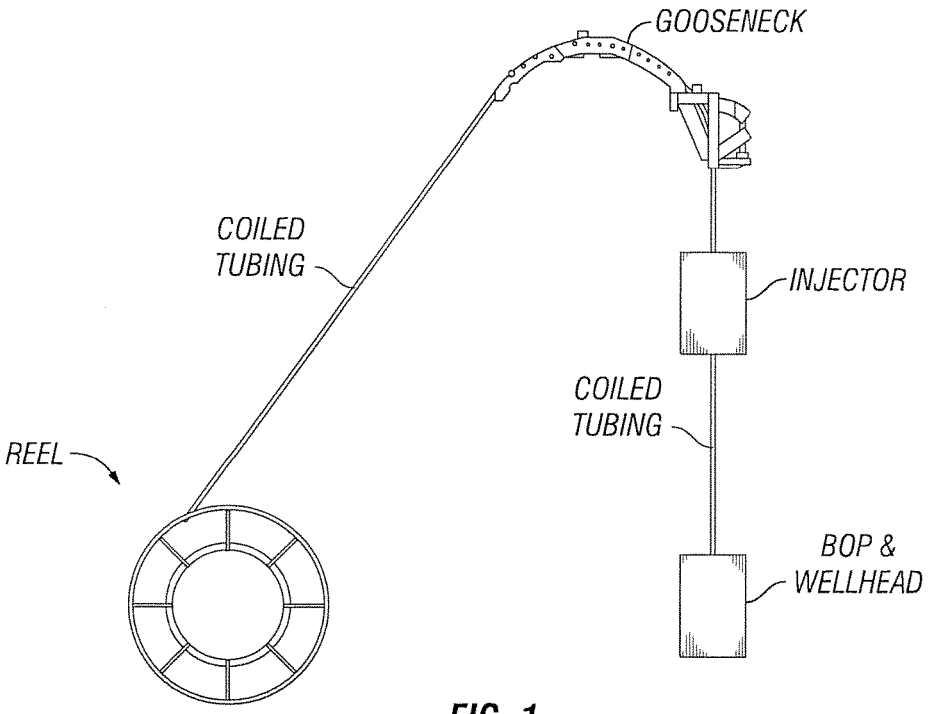
FIG. 1
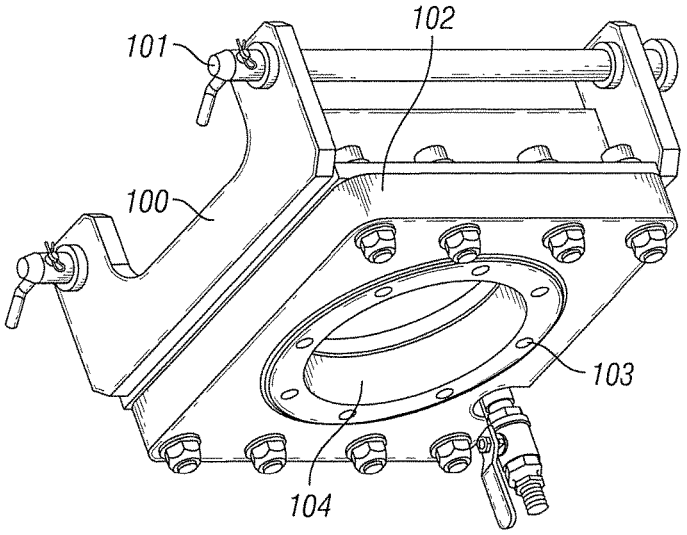
FIG. 2 -- PRIOR ART

UNIVERSAL ROTATING STRIPPER ADAPTER

CROSS-REFERENCE TO RELATED APPLICATIONS

This application claims priority under 35 U.S.C. § 119(e) to U.S. Provisional Application No. 62/396,453 filed on Sep. 19, 2016, which is incorporated herein by reference in its entirety.

FIELD

Embodiments disclosed herein relate to coiled tubing units. More particularly, embodiments disclosed herein relate to an improved stripper adapter for coiled tubing injector head units.

BACKGROUND

In the oil and gas industries, coiled tubing refers to a very long metal pipe supplied spooled on a large reel. It is used for interventions in oil and gas wells and sometimes as production tubing in depleted gas wells. A relatively modern drilling technique involves using coiled tubing instead of conventional drill pipe.

FIG. 1 illustrates generally a coiled tubing setup. The coiled tubing is fed from a reel into the injector which effectively powers the tubing into the wellhead. The end of the coiled tubing string can be outfitted with numerous downhole tools including drill bits and other related drilling equipment. The "gooseneck" is the angled piece on the injector which guides the tubing and allows a bending of the coil string to allow it to go through the injector. It is what guides the tubing from the reel and directs the tubing from an upwards angle and turns it into a vertically downward extending direction into the injector and a device called a "stripper", which contains pack off elements and hydraulically seals the tubing before entering the wellhead. The stripper acts as packing device that allows the tubing to be sealed around the wellhead and blowout preventer (BOP) to prevent backflow of fluids from the well. The injector and gooseneck are connected together and are suspended by a crane or similar lifted methods for operations.

The typical stripper adapter plate that is on a coiled tubing injector is outfitted for one particular tubing size, and is not adjustable to fit numerous tubing sizes. Instead, the stripper adapter plate must be changed out to adjust to different tubing sizes. Different stripper adapter plate manufacturers may have different mounting or hole patterns that do not always correspond with equipment or components not their own. Thus, having a universal plate or a plate that can be changed out to meet any size or brand stripper would be very beneficial in reducing onsite well time, thus improving safety and reducing costs. Similarly, proper alignment of all equipment is important as misalignment case affect the operational efficiency of the coiled tubing unit.

FIG. 2 illustrates a prior stripper mount 100. Most stripper mounts are attached to the bottom of the injector with rails, large pins 101, or other devices that need to be removed that will allow the removal of the stripper adapter. Typical designs have two large devices that are locked into place on either side of the plate, which allow stability. Most stripper mounts need to be changed when the unit is still on the trailer, or a more risky method of approaching the unit from underneath while suspended by a crane or lifting device. The entire adapter must be removed in order to change the size of the tubing, which results in crews having to keep several size adapters in stock, or as back-ups for a failing unit or a defective unit. The units packing does fail, and can be significantly detrimental to operations to have one fail during operation.

Further disadvantages are that the bolt pattern 103 does not rotate freely, and the stripper adapter 104 stays stationary relative to the base 102, so if the wellhead bolt holes are not aligned the operator must pivot the injector, and force the injector into an unnatural non-linear state, which can be detrimental to operational efficiency and cause equipment degradation. Further disadvantages include wasted time on jobsites attempting to pivot the injector head to mate up properly, some crews might even have to completely rig-down equipment and reposition on wells in order for the stripper plate to align with the wellhead.

SUMMARY OF THE INVENTION

In one aspect, embodiments disclosed herein relate to a stripper adapter mounted on a coiled tubing injector head unit, the adapter including a swivel ring secured between an upper thrust washer and a lower thrust washer, wherein the swivel ring is rotatable 360 degrees about a longitudinal axis.

BRIEF DESCRIPTION OF THE DRAWINGS

The invention is illustrated in the accompanying drawings wherein,

FIG. 1 illustrates generally a coiled tubing setup.

FIG. 2 illustrates a prior stripper mount.

DETAILED DESCRIPTION

A universal rotating stripper adapter is disclosed. The universal rotating stripper adapter is configured to be mounted onto coiled tubing injector units and is adaptable to fit with any mounting pattern or tubing size without the need for changing stripper mounts or sacrificing equipment wear and performance. Having a replaceable swivel plate allows for less expensive replacement, less space required for crews to carry spare parts, and the reduced downtime, which also results in savings of crew time.

Figure 3:
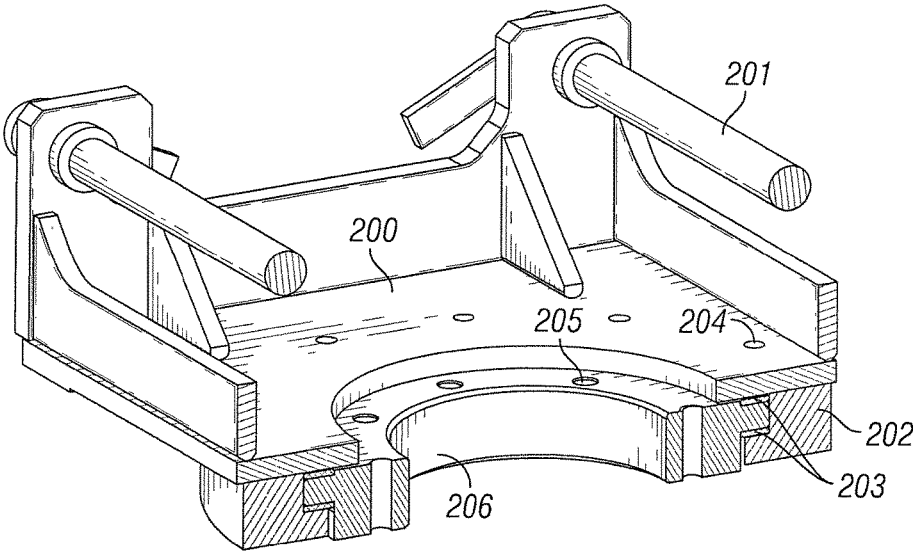
FIG. 3 illustrates a perspective view of an embodiment of a universal rotating stripper adapter.

FIG. 3 illustrates an embodiment of a universal rotating stripper adapter 200. The adapter 200 may be mounted on a coiled tubing injector (not shown) with any type of fastener, for example, locking rods 201. The adapter 200 includes a lower plate 202 attached to a lower surface of the adapter 200 by bolts at mounting holes 204. The adapter 200 further includes a swivel ring 206 mounted between the lower surface of the adapter and the lower plate 202. The swivel ring 206 is generally cylindrical about a longitudinal axis and has a hole through the middle.

Figure 4:
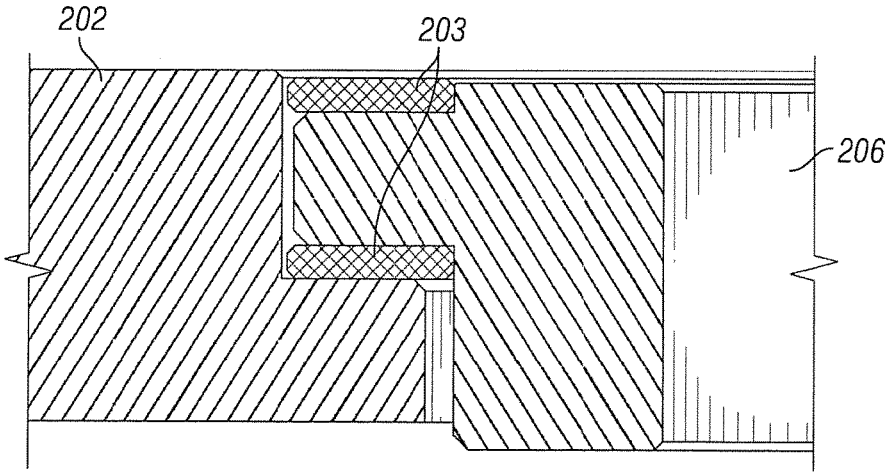
FIG. 4 illustrates a section view of an embodiment of a universal rotating stripper adapter.

Thrust washers 203 are mounted above and below the swivel ring 206 to allow 360 degree rotation of the swivel ring 206. A stripper (not shown) may be attached to the swivel ring 206 at mounting holes 205. FIG. 4 shows a section view of an embodiment of the universal rotating stripper adapter. The swivel plate 206 is able to rotate 360 degrees due to sitting between thrust washers 203 positioned above and below the swivel plate 206. Rotation of the swivel plate 206 is a significant achievement in that the injector does not need to be turned at a slight angle or repositioned to fit the needs of a bolt pattern on a wellhead or wellhead equipment. The swivel plate allows for easy 360 degree rotation for positioning and effortless connection. The location and sizing of the two thrust washers 203 allows the mount assembly to swivel when the injector head unit exhibits either an upward force from the BOP or wellhead, or the downwards force from a injector unit.

To replace the swivel ring 206, or the stripper packing, outer mount bolts and nuts may be removed from mounting holes 204, to allow the swivel ring 206 to be removed from the mount 202, and then re-positioned to secure the swivel plate 206 and thrust washers 203.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A stripper adapter mounted on a coiled tubing injector head unit, the adapter comprising:

a swivel ring located between a lower surface of the stripper adapter and a lower plate attached below the lower surface;

a thrust washer located between a portion of the swivel ring and the lower surface, and a thrust washer located between a portion of the swivel ring and the lower plate, wherein the swivel ring is rotatable 360 degrees about a longitudinal axis, wherein the swivel ring comprises one or more locations for attaching a stripper rubber to the swivel ring.

2. The stripper adapter of claim 1, further comprising a support mount for attaching the stripper adapter to the coiled tubing injector head unit.

* * * * *